US006354115B1

(12) United States Patent
Zahn

(10) Patent No.: US 6,354,115 B1
(45) Date of Patent: Mar. 12, 2002

(54) TWO-COMPONENT SEAL FOR A WASHING MACHINE SPIN TUB

(75) Inventor: Henry W. Zahn, Tulsa, OK (US)

(73) Assignee: Clark Seals, Ltd., Tulsa, OK (US)

( * ) Notice: Subject to any disclaimer, the term of this patent is extended or adjusted under 35 U.S.C. 154(b) by 0 days.

(21) Appl. No.: 09/421,900

(22) Filed: Oct. 21, 1999

(51) Int. Cl.[7] ..... D06F 37/20
(52) U.S. Cl. ..... 68/23.7; 68/23.3; 68/133
(58) Field of Search ..... 68/133, 23.2, 23.3, 68/23.7, 140

(56) References Cited

U.S. PATENT DOCUMENTS

| | | | | | |
|---|---|---|---|---|---|
| 1,985,273 | A | * | 12/1934 | Altorfer | 68/133 |
| 2,047,822 | A | * | 7/1936 | Dunham | 68/133 |
| 2,078,139 | A | * | 4/1937 | Hansen | 68/133 |
| 2,197,640 | A | * | 4/1940 | Hansen | |
| 2,255,505 | A | * | 9/1941 | Dunham | 68/133 |
| 2,385,623 | A | * | 9/1945 | Geldhof et al. | |
| 2,641,426 | A | * | 6/1953 | Rauscher | |
| 2,942,445 | A | * | 6/1960 | Burkland | |
| 2,948,128 | A | * | 8/1960 | Smith | 68/133 |
| 3,184,934 | A | * | 5/1965 | Smith | 68/133 |
| 3,535,897 | A | | 10/1970 | Douglas | 68/23.3 |
| 3,604,029 | A | * | 9/1971 | Bain | |
| 3,710,947 | A | | 1/1973 | Charhut | 210/380 |
| 3,793,854 | A | | 2/1974 | Brucken | 68/23.7 |
| 3,793,855 | A | | 2/1974 | Sisson | 68/23.7 |
| 4,061,000 | A | | 12/1977 | Jacobs | 68/23.7 |
| 4,224,811 | A | | 9/1980 | Yamashita | 68/12 |
| 5,105,636 | A | | 4/1992 | Anastase et al. | 68/140 |
| 5,551,262 | A | | 9/1996 | Seo | 68/23.7 |
| 5,586,455 | A | | 12/1996 | Imai et al. | 68/12.02 |
| 5,778,703 | A | | 7/1998 | Imai et al. | 68/12.02 |
| 5,842,358 | A | | 12/1998 | Koo et al. | 68/23.7 |
| 5,862,685 | A | | 1/1999 | Lim | 68/23.7 |
| 5,887,458 | A | | 3/1999 | Bae | 68/23.7 |
| 6,202,451 | B1 | * | 3/2001 | Park et al. | 68/23.7 |

FOREIGN PATENT DOCUMENTS

| | | | | |
|---|---|---|---|---|
| CA | 511527 | * | 4/1955 | 68/133 |
| DE | 1059392 | * | 6/1959 | |
| JP | 60-25988 | * | 6/1985 | |

* cited by examiner

*Primary Examiner*—Frankie L. Stinson
(74) *Attorney, Agent, or Firm*—Head, Johnson & Kachigian

(57) ABSTRACT

A two-component seal for the spin tub of a washing machine. The two-component seal is disposed about the tub opening and a metal shroud seal to prevent water in the washer from entering a motor and bearing space. The top seal includes a metal case with multiple sealing surfaces. The presence of multiple sealing surfaces provides a sealing force against the shaft shroud seal to seal during operation and compensate for seal wear over time, extending the seal life. The top seal has a stiffener made of metal. A resilient elastomeric cover encloses the stiffener, except for top and bottom tabs. A bottom tab prevents slipping between the tub seal and bottom assembly. The bottom tabs additionally have a lip which engages the shroud seal made from materials which allow sealing lips to seal on a softer metal shaft. The bottom seal also has a resilient metallic stiffener enclosed by a resilient bottom cover. The bottom seal further has a vertical wall and a horizontal flange. Annular wedges on the bottom seal bias the bottom seal vertical wall inwardly, forming a resiliently expansible annular hub. The resilient biasing of the hub make the two-component seal self aligning because any forces acting on the bearings to cause misalignment are counteracted and dampened by reactive resilient biasing forces of the two-component seal.

16 Claims, 3 Drawing Sheets

TWO-COMPONENT SEAL FOR A WASHING MACHINE SPIN TUB

BACKGROUND OF THE INVENTION

1. Field of the Invention

The present invention is for a tub seal assembly for a clothes washing machine.

2. Description of the Related Art

The household and industrial clothes washing machine has an outer tub, an agitator, a perforated spin tub and a drive shaft which connects the motor and transmission to the agitator. The drive shaft extends axially through the bottom of the tub to the agitator and supports the perforated spin tub which is connected to the motor through the transmission. The spin tub is perforated along its sidewall so that water will be centrifugally forced from the spin tub when the spin tub is turned at a high rate of speed, or pumped from the spin tub when stationary.

To operate the washing machine, a user places clothes into the perforated spin tub. The outer tub is then partially filled with water. During a wash cycle, the agitator agitates, vibrates or oscillates the clothes to remove dirt and stains. After the rinse cycle is complete, the washing machine begins a spin cycle. Water is first pumped from the outer tub by a pump while the spinning tub removes excess water from the clothes.

During the washing and rinsing cycles when water is in the tub, a seal must be provided to prevent water from leaking into the electric drive motor and bearing assembly. However, seals of the existing art have encountered problems. One type of seal encountering such difficulty is a mechanical face seal, which typically consists of two faces, one face composed of a ceramic material and the other of a carbon-based material. Such mechanical face seals are subject to excessive wear from sand and dirt present in the washing fluid. Mechanical seal faces are held together by a spring to seal against tub wobble which results from unbalanced washing loads, and misalignment between the drive shaft, tub, bearing and seal. Such tub wobble and misalignment force open the seal faces resulting in leakage during routine operating conditions. Though shaft seals have typically been made from elastomeric compounds, such seals are not designed to maintain proper alignment of multiple parts within a washing machine.

SUMMARY OF THE INVENTION

The present invention is for a two-component seal for a spin tub of a washing machine. A bottom seal aligns and positions the tub while sealing against the tub bottom, the tub opening and the top seal. It aligns the top seal, the bearing and the drive shaft. The top and bottom tub seals are made of an elastomeric compound. The seals are reinforced with metal shapes to insure alignment of the drive shaft, bearing, tub and agitator. The resiliency of the seal material and the use of sealing lips also helps to accommodate any irregularity in the washing machine spin tub which may result in leaking.

The two-component seal is disposed about the tub opening and a metal shroud seal to prevent water in the washer from entering the motor and bearing space. The top seal includes a metal case with multiple sealing surfaces. The presence of multiple sealing surfaces prevent fluid, dirt and sand from destroying the sealing mechanism. Sealing lips stretch and a circumference spring provides a sealing force against the shaft shroud seal to seal during operation and to compensate for seal wear over time, extending the seal life. Multiple sealing surfaces are unitized to prevent fluid leakage and maintain the alignment of the drive shaft, bearing, tub and seal.

The top seal embodies a stiffener made of metal. A resilient elastomeric top cover encloses the stiffener, except for top and bottom tabs. The bottom tab prevents slipping between the tub seal and bottom assembly. The bottom tabs have lips which engage the shroud seal that are comprised of materials which allow the lips to seal on a softer metal shaft.

The bottom seal has a resilient metallic stiffener enclosed by a resilient bottom cover. The bottom seal has a vertical wall and a horizontal flange. Annular wedges on the bottom seal bias the bottom seal vertical wall inwardly, forming a resiliently expansible annular hub. The resilient biasing of the hub make the two-component seal self aligning as forces acting on the bearings to cause misalignment are counteracted and dampened by the reactive resilient biasing forces of the two-component seal.

It is therefore a principal object of the invention to seal water in the housing of a washing machine and prevent it from entering the motor and bearing space.

It is a further object of the invention to provide a two-component tub seal with redundant sealing mechanisms.

It is another object of the invention to provide a two-component tub seal which prevents misalignment of the bearing, drive shaft, tub and agitator assembly.

It is a still further object of the invention to provide a two-component tub seal which is durable and does not experience excessive wear.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Like part numbers in the various drawings indicate like parts of the present invention.

Figure 1:
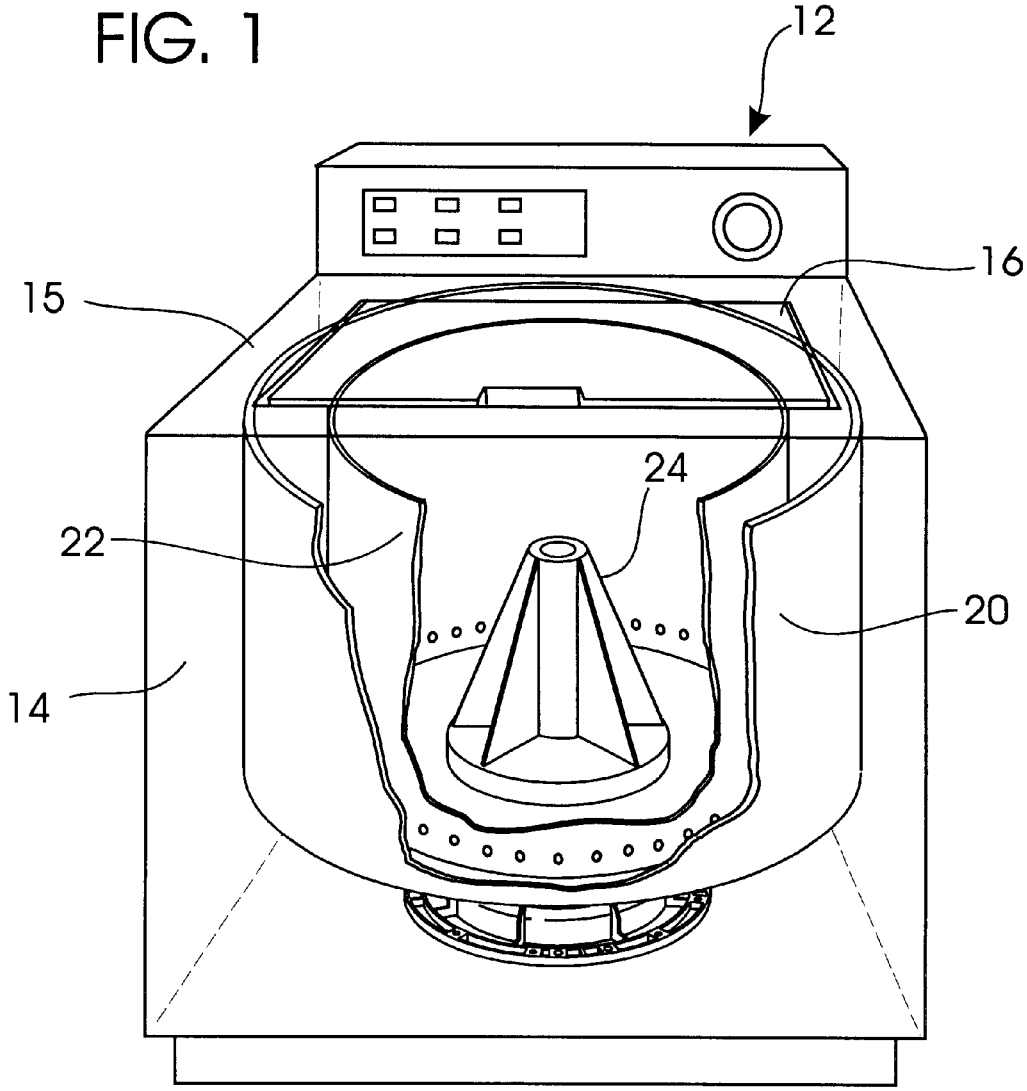
FIG. 1 shows a cut-away, perspective view of a washing machine.

In FIG. 1, a clothes washing machine 12 includes a metal casing 14 and a top 15. A door 16 in the top of the washing machine 12 permits clothes to be put into or taken out of the washing machine 12. The casing 14 houses a nested tub.

The nested tub includes an outer container 20 to contain water and a perforated spin tub 22 which turns during a "spin cycle." During a "wash cycle," water is admitted into the outer container 20 and detergent is added to the water. An agitator 24 on a shaft 26 in the middle of the washing machine 12 oscillates while the outer container 20 and spin tub 22 remain stationary. The agitating action in the presence of water and detergent cleans the clothes.

After the clothes are washed, the water is pumped from the outer container 20. Next, during the spin cycle, the spin tub 22 rotates at a rapid rate of speed to centrifugally force water from the clothes through perforations 30 in the spin tub 22.

Figure 2:
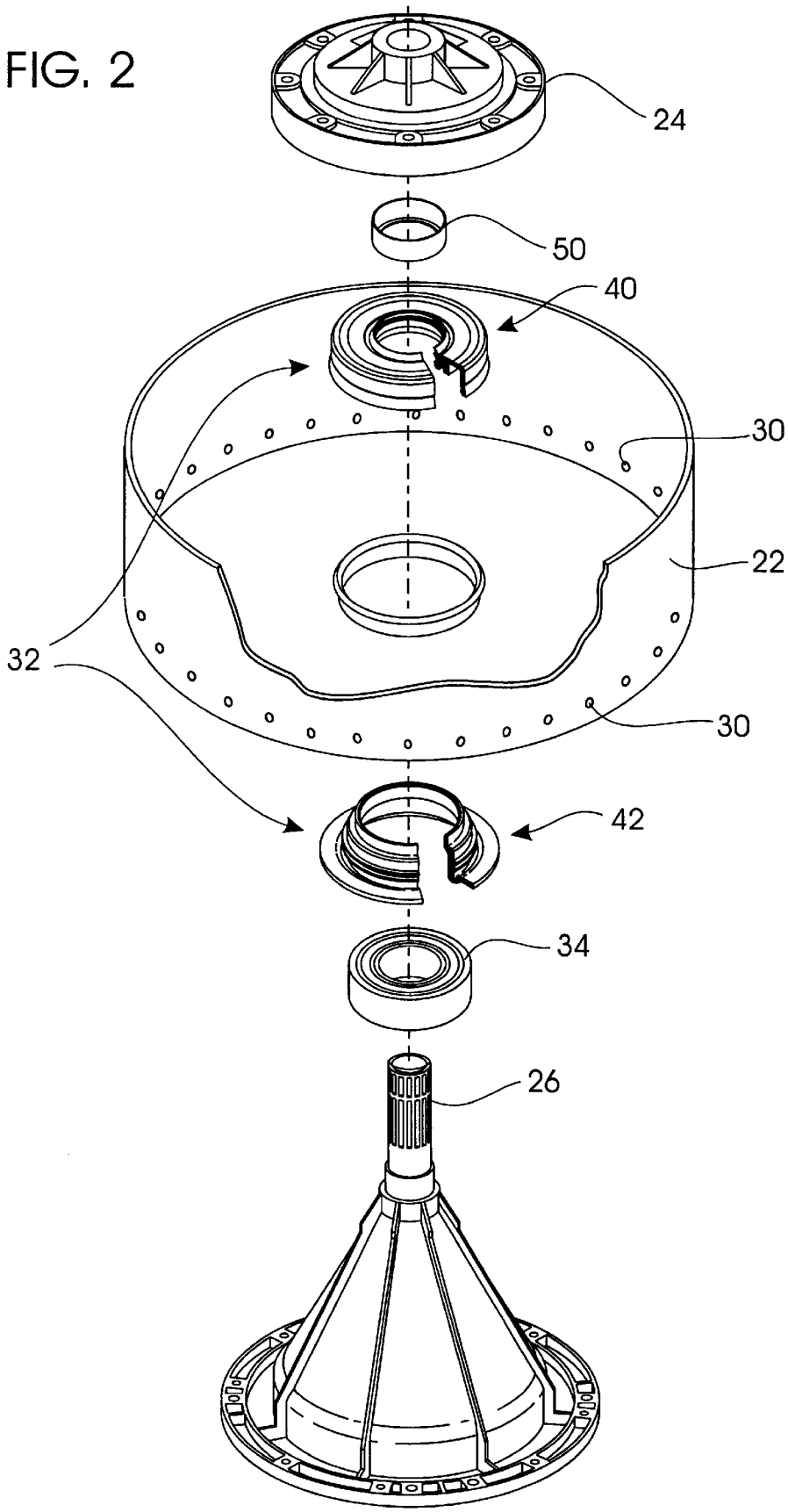
FIG. 2 shows a sectional view of the seal assembly of the present invention, taken along a radius of the spin tube.
Figure 3:
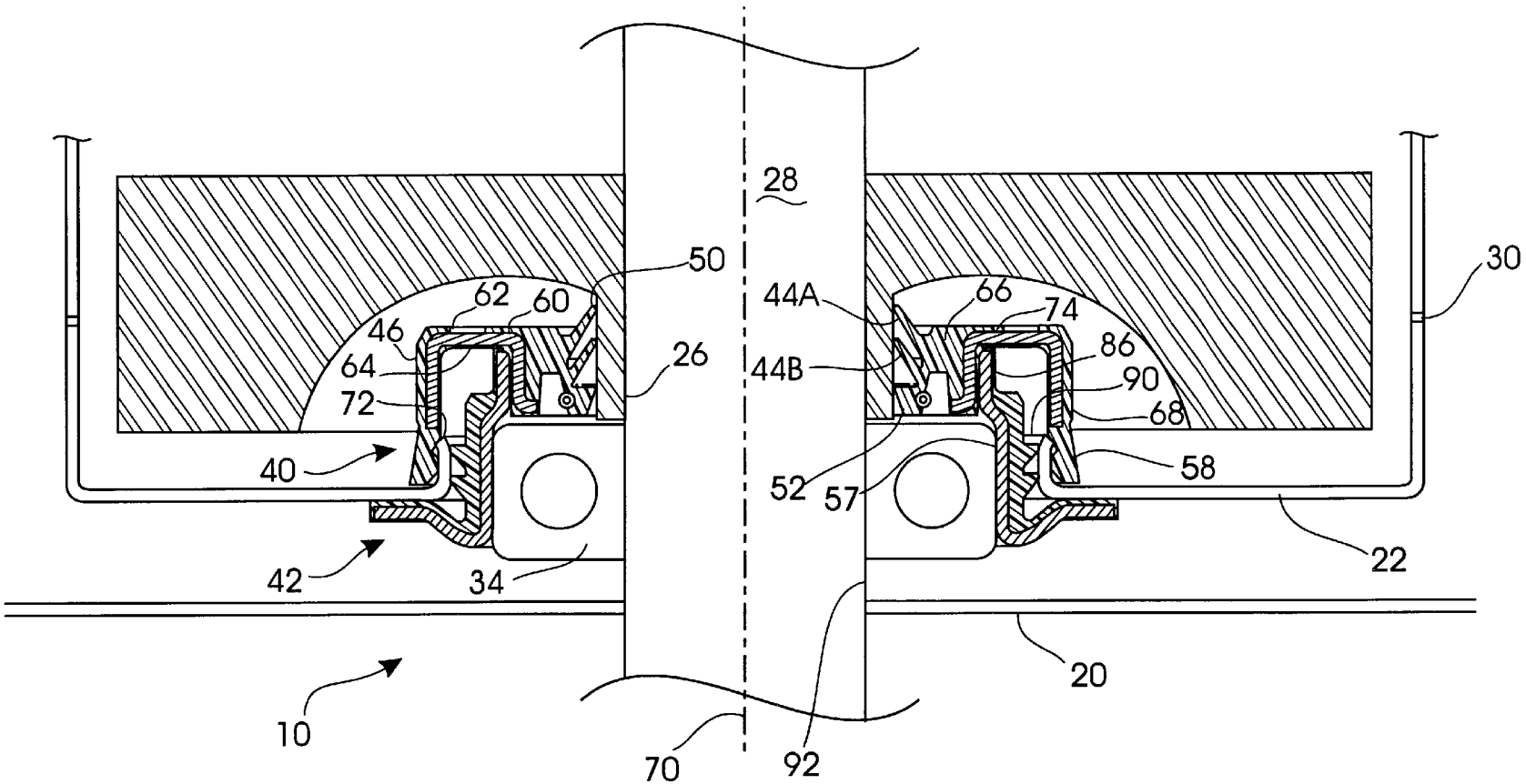
FIG. 3 shows an exploded isometric view of the seal assembly of the present invention.

In FIGS. 2 and 3, a two-component tub seal 32 of the present invention is disposed about the spin tube 28 to prevent water from entering a space housing a bearing 34 and motor/transmission assembly. This is desirable because water present in the outer tub 20 can adversely affect functionality of the bearing 34 and motor/transmission assembly. The two-component tub seal 32 has a top seal 40, seal 42 and shroud seal 50.

A seal top metal stiffener 60 is embedded inside the seal top cover, except for top tabs 62 and bottom tabs 64. As best seen in FIG. 3, the top tabs 62 and bottom tabs 64 do not form annular rings, but are circumferentially spaced at a fixed distance from the center 70 of the two-component seal 32. The top tabs 62 and the bottom tabs 64 fix the position of the top seal 40 with respect to the top stiffener 60.

The top seal 40 has a lip 56 which engages a hollow 57 on a vertical surface of an interior wall 58 of the outer tub 20. The top stiffener 60 has the general shape of an upside down letter "U" with an inner wall 66 and an outer wall 68. When one presses down on the top 70 of the top seal 40, the outer wall 68 deflects outwardly. As one presses down further, the resiliency of the top stiffener 60 causes the lip 56 to positively engage the hollow 57.

The bottom seal 42 has a resilient metallic bottom stiffener 80 enclosed by a resilient bottom cover 82. The resilient bottom cover 82 is typically made of elastomeric materials but may be made from other heat resistant resilient material. The bottom seal 42 has a vertical wall 86 and a horizontal flange 88. Resilient annular wedges 90 resiliently bias the bottom seal vertical wall 86 inwardly, toward the center of the spin tube 28, forming a resiliently expansible annular hub. Because the hub is resiliently expansible, the two-component seal 32 is capable of self-alignment. That is, forces which may act on the bearing assembly 34 to cause misalignment between the bearing assembly 34 and the spin tube 28 are dampened and counteracted by reactive resilient biasing forces of the two-component seal 32.

The bottom stiffener 80 is shaped so that the horizontal flange 88 is biased against the outer tub 20 and locked in position by a pin mechanism commonly utilized and known by those versed in the art. The resiliency of the bottom stiffener 80 and the bottom cover 82 and the horizontal flange 88 seals the engaging surfaces of the outer tub 20.

Whereas, the present invention has been described in relation to the drawings attached hereto, it should be understood that other and further modifications, apart from those shown or suggested herein, may be made within the spirit and scope of this invention.

I claim:

1. A two-component seal for a washing machine tub to seal water in an outer tub from getting into the washing machine motor and bearing assembly located generally below the tub, wherein said tub has an interior wall, and said washing machine has an agitator with a shroud seal positioned about a drive shaft of the agitator, said two-component seal comprising:

(a) an annular top seal having a metal case with a plurality of sealing lips biased against said shroud seal; and (b) an annular bottom seal positioned between a washing machine spin tub and outer tub, said section and wherein a plurality of resilient wedges bias said bottom seal against said bearing assembly.

2. The two component seal of claim 1, wherein the top seal further comprises:

(a) a metal top stiffener of said top seal;

(b) a resilient elastomeric top cover substantially covering said top stiffener; and (c) a lip to engage an interior bottom opening in said tub to facilitate attachment of said top seal to said tub.

3. A sealing assembly for an outer tub of a washing machine, said washing machine having an agitator shaft which oscillates during a wash cycle and remains stationary during a spin cycle, said washing machine also having a spin tub which remain stationary during a wash cycle and which rotates during a spin cycle, said assembly comprising:

(a) a shroud seal surrounding a spin tube, said shroud seal rotates stationary during a spin cycle of said washing machine;

(b) an annular top seal positioned against said shroud seal, wherein said annular top seal remains stationary when said spin tub rotates; and (c) an annular bottom seal wherein said annular bottom seal remains stationary when said spin tub rotates.

4. The sealing assembly of claim 3 wherein said bottom seal defines an annular hub which receives and aligns a bearing assembly for a spin tube of said washing machine.

5. The sealing assembly of claim 4 further comprising annular wedges on said bottom seal to resiliently bias said circular hub inwardly to secure the bearing assembly.

6. The sealing assembly of claim 3 further comprising multiple sealing lips that stretch and provide a sealing force against said shroud seal.

7. The sealing assembly of claim 3 wherein multiple sealing lips seal water in the outer tub during the wash cycle.

8. A two-component seal assembly for a washing machine which washes clothes during a wash cycle and which centrifugally removes water from the clothes in a spin cycle, said washing machine having (i) an agitator which agitates the clothes, (ii) an agitator shaft attached to the agitator to oscillate the shaft during the wash cycle, said shaft remaining substantially stationary during the spin cycle, (iii) a spin into which the clothes are placed for washing, wherein said spin tub is substantially stationary during the wash cycle and rotates during the spin cycle, (iv) a spin tube attached to the spin tub to rotate the spin tub during the spin cycle, and (v) a seal assembly aligns with the spin tube, said assembly comprising:

(a) a metal case annular upper seal and a shroud seal attached to said spin tube, wherein said shroud seal rotates when the spin tub rotates; and (b) an annular lower seal wherein said annular lower seal remains stationary when said spin tube rotates.

9. The two-component seal assembly of claim 8, wherein the top seal further comprises:

(a) a resilient elastomeric upper cover substantially covering said upper metal case; and (b) a sealing lip to engage the interior wall of an outer tub.

10. The two-component seal assembly of claim 9, wherein the lower seal further comprises:

(a) a metal case of said lower seal; and (b) a resilient elastomeric bottom cover substantially covering said lower stiffener.

11. The two-component seal assembly of claim 10 further comprising a bottom tab to prevent slippage of the resilient elastomeric bottom cover with respect to the bottom metal case.

12. The two-component seal assembly of claim 10, wherein the lower seal further comprises:

(a) an annular shoulder which pivotally retracts from the shroud seal when said upper seal rotates about said shaft.

13. The two-component seal assembly of claim 9 further comprising a top tab to prevent slippage of the resilient elastomeric top cover with respect to the top metal case.

14. The two-component seal assembly of claim 8 wherein said lower seal defines an annular hub which receives and aligns the bearing assembly for the spin tube of the washing machine.

15. The two-component seal assembly of claim 14 further comprising annular wedges on said lower seal to resiliently bias said circular hub inwardly to secure the bearing assembly.

16. The two-component seal assembly of claim 8 wherein the upper seal further comprises a metal case resiliently biased against the inner wall of a washing machine outer tub by hydrostatic water pressure in the tub during a wash cycle, and retracts from the shroud seal during a spin cycle.

* * * * *